US008875421B2

(12) United States Patent
Paull

(10) Patent No.: US 8,875,421 B2
(45) Date of Patent: Nov. 4, 2014

(54) APPARATUS FOR ADAPTING A HOE BUCKET FOR DEPTH CONTROL

(71) Applicant: Philip Paull, Noblesville, IN (US)

(72) Inventor: Philip Paull, Noblesville, IN (US)

( * ) Notice: Subject to any disclaimer, the term of this patent is extended or adjusted under 35 U.S.C. 154(b) by 0 days.

(21) Appl. No.: 14/084,046

(22) Filed: Nov. 19, 2013

(65) Prior Publication Data

US 2014/0222301 A1 Aug. 7, 2014

Related U.S. Application Data

(63) Continuation-in-part of application No. 13/774,062, filed on Feb. 22, 2013, which is a continuation-in-part of application No. 12/876,080, filed on Sep. 3, 2010, now Pat. No. 8,437,921.

(60) Provisional application No. 61/240,158, filed on Sep. 4, 2009, provisional application No. 61/727,982, filed on Nov. 19, 2012.

(51) Int. Cl.
*E02F 3/36* (2006.01)
*E02F 9/26* (2006.01)

(52) U.S. Cl.
CPC ..... *E02F 9/265* (2013.01)
USPC ..... 37/404; 37/444; 172/233; 172/234

(58) Field of Classification Search
USPC ..... 37/403, 404, 407, 410, 444; 172/233, 172/234, 664
See application file for complete search history.

(56) References Cited

U.S. PATENT DOCUMENTS

| | | | | | |
|---|---|---|---|---|---|
| 2,042,196 | A * | 5/1936 | Senz | 172/777 |
| 2,899,760 | A * | 8/1959 | Armington et al. | 172/777 |
| 2,993,285 | A * | 7/1961 | Hoxie | 172/777 |
| 3,065,557 | A * | 11/1962 | Pewthers | 299/67 |
| 3,113,390 | A * | 12/1963 | Pewthers | 37/447 |
| 3,238,648 | A * | 3/1966 | Cobb et al. | 172/664 |
| 4,512,090 | A * | 4/1985 | Billings | 37/405 |
| 4,625,438 | A * | 12/1986 | Mozer | 37/447 |
| 4,967,850 | A * | 11/1990 | Bargfrede et al. | 172/197 |
| 5,253,449 | A * | 10/1993 | Webb et al. | 37/446 |
| 6,032,093 | A * | 2/2000 | Denbraber et al. | 701/50 |
| 6,434,863 | B1 * | 8/2002 | Meurer | 37/410 |
| 6,460,276 | B1 * | 10/2002 | Ireland et al. | 37/447 |
| 7,891,121 | B2 * | 2/2011 | Smoljo | 37/447 |
| 8,437,921 | B2 * | 5/2013 | Paull | 701/50 |

* cited by examiner

*Primary Examiner* — Gary Hartmann
(74) *Attorney, Agent, or Firm* — Brannon Sowers & Cracraft PC; C. John Brannon

(57) ABSTRACT

A kit for modifying a digging bucket for controlling the depth cut, including an elongated member operationally connectable to a hoe bucket defining a cutting edge, an actuator operationally connectable to the elongated member, an electronic controller operationally connectable to the actuator, and a position sensor operationally connectable to the cutting edge and operationally connectable to the electronic controller. The actuator may be energized to pivot the elongated member to a position adjacent the cutting edge for engaging ground. Positioning of the elongated member adjacent the cutting edge prevents the cutting edge from digging ground.

5 Claims, 15 Drawing Sheets

APPARATUS FOR ADAPTING A HOE BUCKET FOR DEPTH CONTROL

CROSS-REFERENCE TO RELATED APPLICATIONS

This patent application is a continuation in part of and claims priority to co-pending U.S. patent application Ser. No. 13/774,062, filed on Feb. 22, 2013, which claim priority to then U.S. patent application Ser. No. 12/876,080, filed on Sep. 3, 2010, and issued on May 7, 2013, as U.S. Pat. No. 8,437,921, which claimed priority to U.S. Provisional Patent Application Ser. No. 61/240,158, filed on Sep. 4, 2009. This patent application also claims priority to U.S. Provisional Patent Application Ser. No. 61/727,982, filed on Nov. 19, 2012.

TECHNICAL FIELD

The present novel technology relates generally to the field of mechanical engineering, and, more particularly, to a method and apparatus for preventing a back hoe bucket from digging beyond a predetermined depth or grade.

BACKGROUND

Keeping on grade while digging with a back hoe continues to be a challenge even for the most experienced operators. More so than most digging machines, the extended lever arm of the hoe combined with the downward digging forces applied to produce wiggling and vibration of the hoe arm and bucket. Even experienced operators, having developed a tactile 'feel' for how well the bucket is digging and cutting, have difficulty maintaining grade, and the more precisely grade must be maintained, the more difficult and draining the job. While very good operators are able to maintain grade reasonably well even over prolonged digging sessions, the job does take its toll both physically and mentally.

Conventional laser alignment and even GPS guided devices have been developed to give the operator more reliable feedback regarding how close the digging bucket is to the desired grade. Such devices provide feedback to the operator that the bucket is too high, too low, or on grade at any given time during the digging operation. However, the operator must still receive and manually respond to the feedback signals (up or down) provided by the devices. Such constant correction of the bucket depth has proven to be physically demanding and exhausting.

Thus, there is a need for a system for automatically preventing overdigging and for automatically keeping the excavation on a predetermined grade. The present novel technology addresses this need.

SUMMARY

The present novel technology relates to a method and apparatus for maintaining a predetermined grade while digging with a back hoe. One object of the present novel technology is to provide an improved means for generating laser lines. Related objects and advantages of the present novel technology will be apparent from the following description.

DETAILED DESCRIPTION OF THE PREFERRED EMBODIMENT

Figure 1:
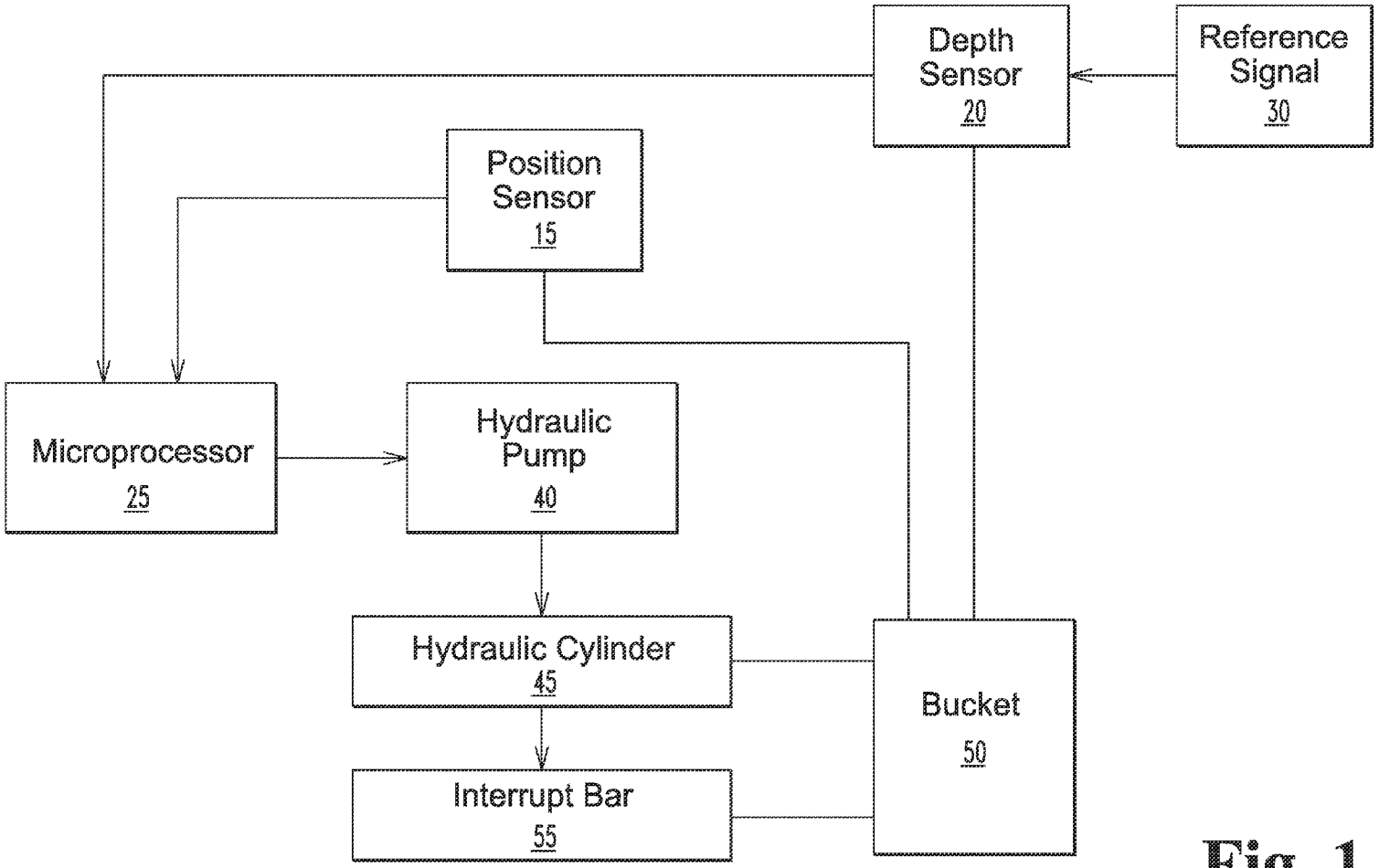
FIG. 1 is a schematic diagram of a first embodiment of the present novel technology, a system for automatically maintaining a back hoe bucket on grade during a digging operation.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

A first embodiment of the present novel technology is illustrated in FIGS. 1 and 3-9C, a system 10 for automatically preventing a track hoe bucket, back hoe bucket, loader bucket, skid loader bucket or like bucket or shovel from digging substantially deeper than a predetermined grade depth parameter. While the following example and drawings focus on a hoe bucket, the claimed novel technology is not limited to a hoe system and includes other digging machines, such as front loaders and the like. The system 10 includes a position sensor 15 and a depth sensor 20 operationally connected to a microprocessor 25 and likewise connected in communication with a reference signal 30. The sensors 15, 20 may be separate, or may both be the same (such as a GPS transceiver). Further, some embodiments may only have a depth sensor 20, while others may only have a position sensor 15. The reference signal 30 may be from a GPS satellite, a laser, or the like.

The microprocessor 25 is also connected to an actuator assembly 37. The actuator assembly typically 37 includes a pressure source or pump 40, such as a hydraulic or pneumatic pump 40 is connected in fluidic communication with at least one hydraulic or pneumatic cylinder 45. The hydraulic cylinder 45 is fixedly, and typically pivotably, connected to a hoe or shovel bucket or blade 50 having a cutting edge or teeth 53. While actuator assembly 37 is described herein as being of the pressurized piston/cylinder type, actuator assembly 37 may likewise include other types of actuators, such as mechanical, electromechanical, or the like.

Bucket 50 is likewise connected to the distal portion of a hoe armature 51. The hydraulic cylinder 45 is also operationally connected to an interrupt bar 55, which is likewise pivotably connected to the bucket 50. The position and depth sensors 15, 20 are likewise operationally connected to the bucket 50 such that the depth of the bucket, and the cutting edge 53, is either directly measured (such as by direct attachment of the sensor(s) 15, 20 to the bucket 50), or calculated (such as by connection of the sensor(s) 15, 20 to a predetermined position on the distal portion of the armature 51 connected to the bucket 50).

Figure 7:
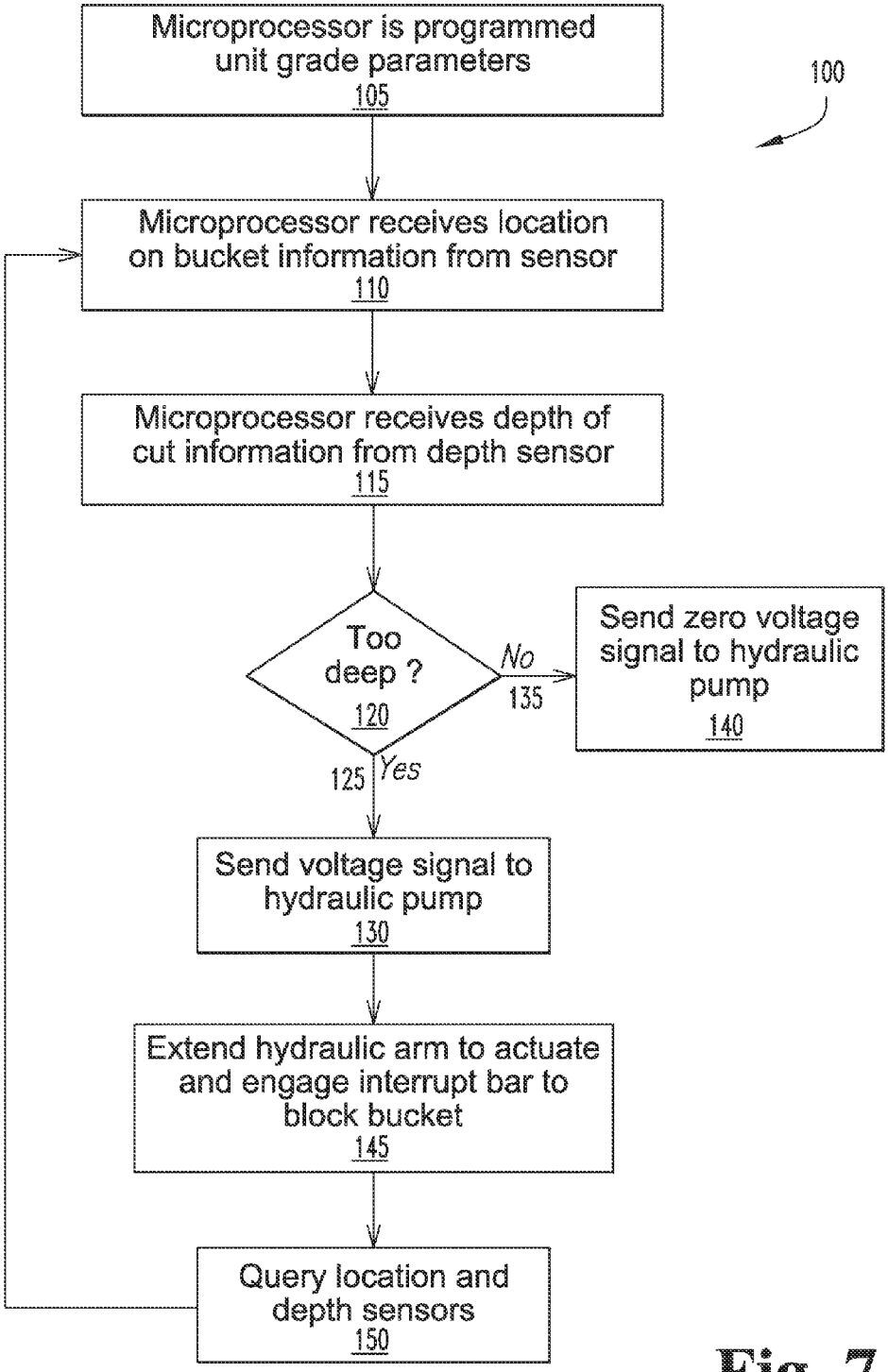
FIG. 7 is a schematic diagram of the process of FIG. 1.
Figure 8:
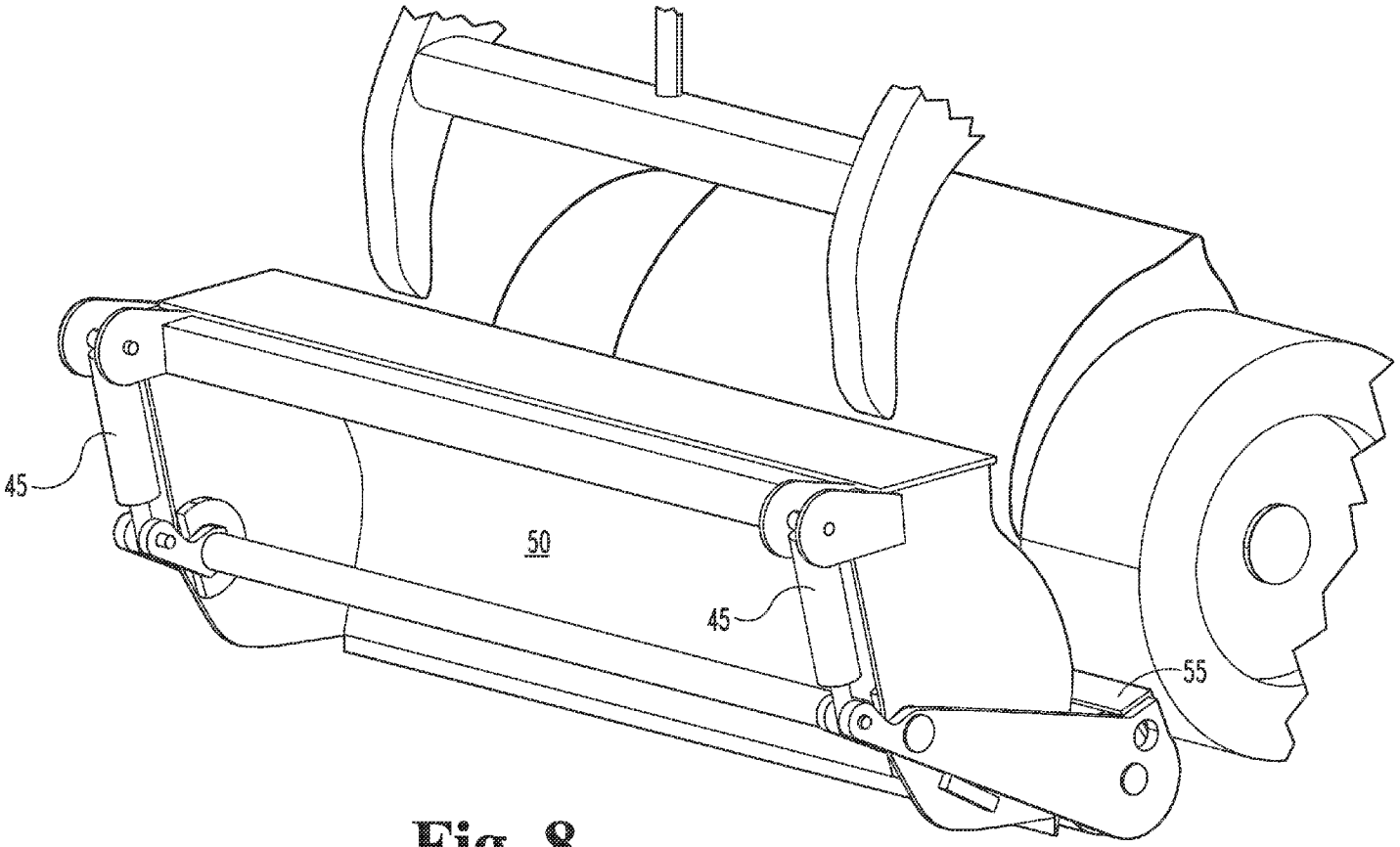
FIG. 8 a perspective view of a first embodiment system including an elongated bucket and interrupt bar assembly as connected to a skid loader.
Figure 9C:
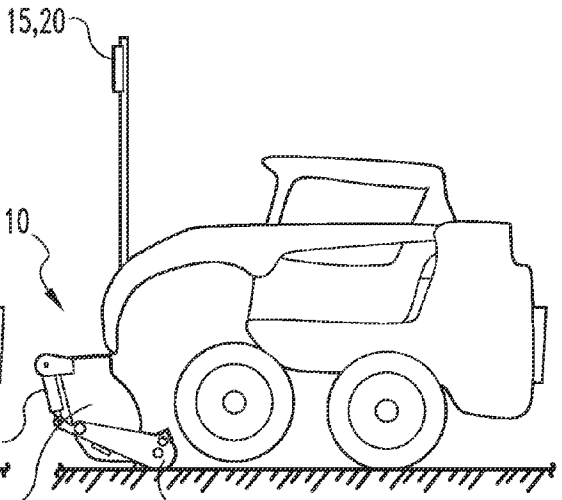
FIG. 9C is a schematic view of the loader of FIG. 8 with the interrupt bar in a deployed position adjacent the cutting edge of the bucket.
Figure 9B:
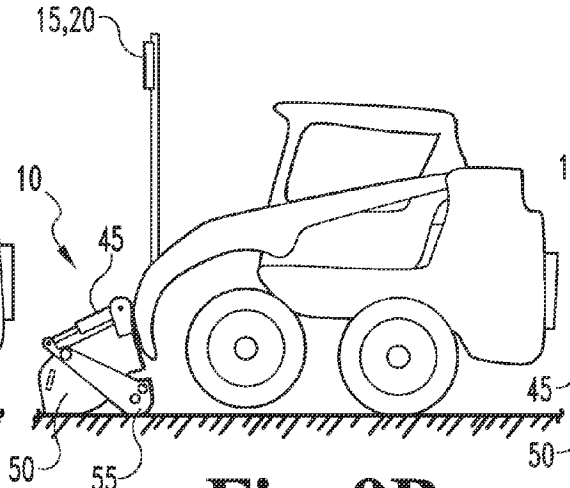
FIG. 9B is a schematic view of the loader of FIG. 8 with the interrupt bar moved toward a deployed position adjacent the cutting edge of the bucket.
Figure 9A:
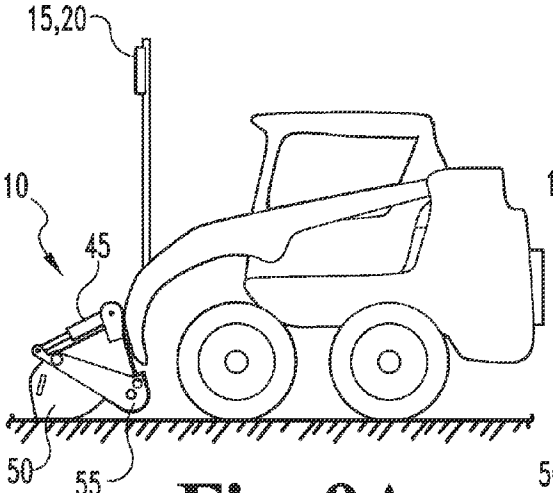
FIG. 9A is a schematic view of the loader of FIG. 8 with the interrupt bar positioned away from the cutting edge of the bucket.
Figure 10:
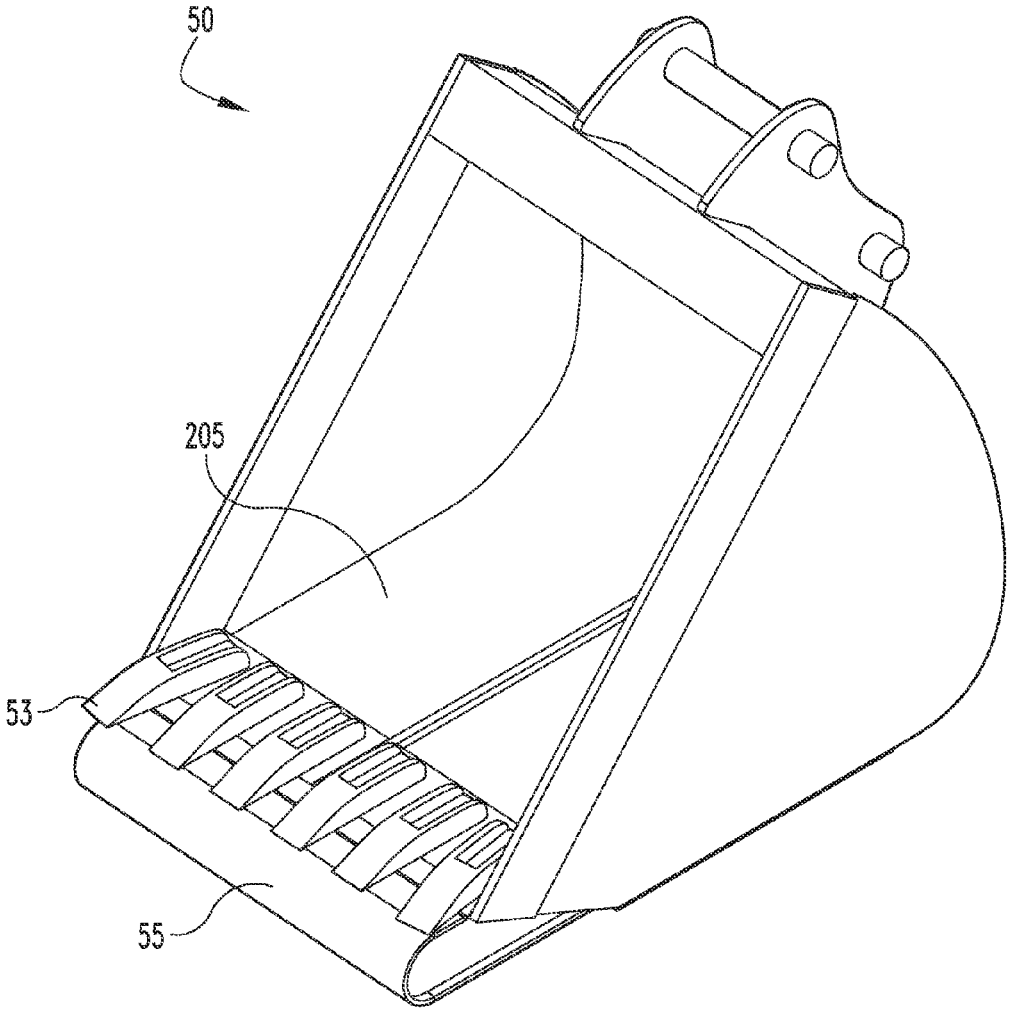
FIG. 10 is a front perspective view of another embodiment back hoe bucket according to the system of FIG. 2.
Figure 11:
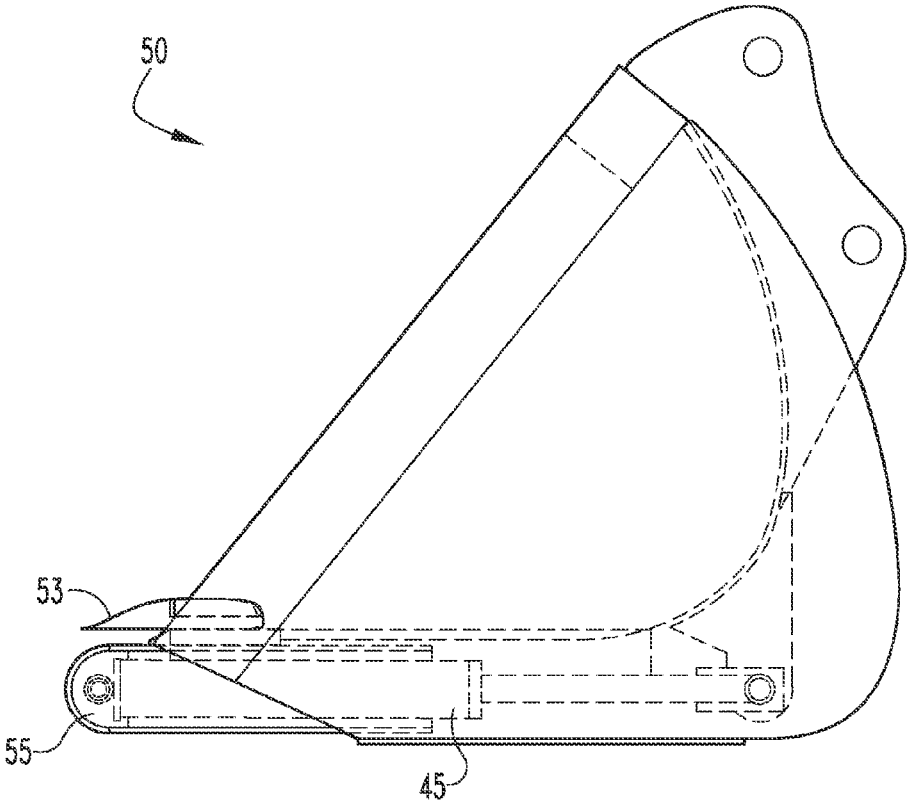
FIG. 11 is a partially cut away side elevation view of the bucket of FIG. 10.
Figure 12B:
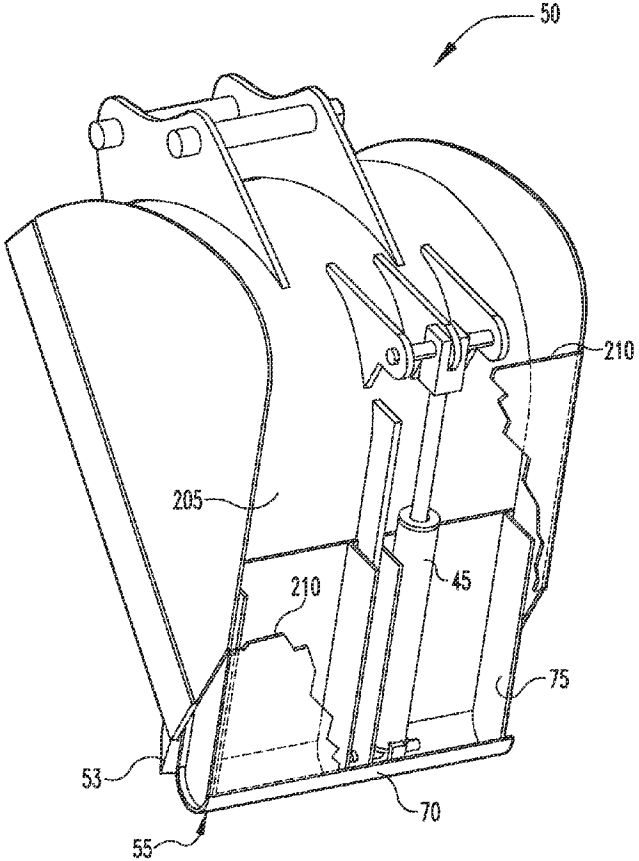
FIG. 12B is a partially cut away rear perspective view of the bucket of FIG. 10.
Figure 12A:
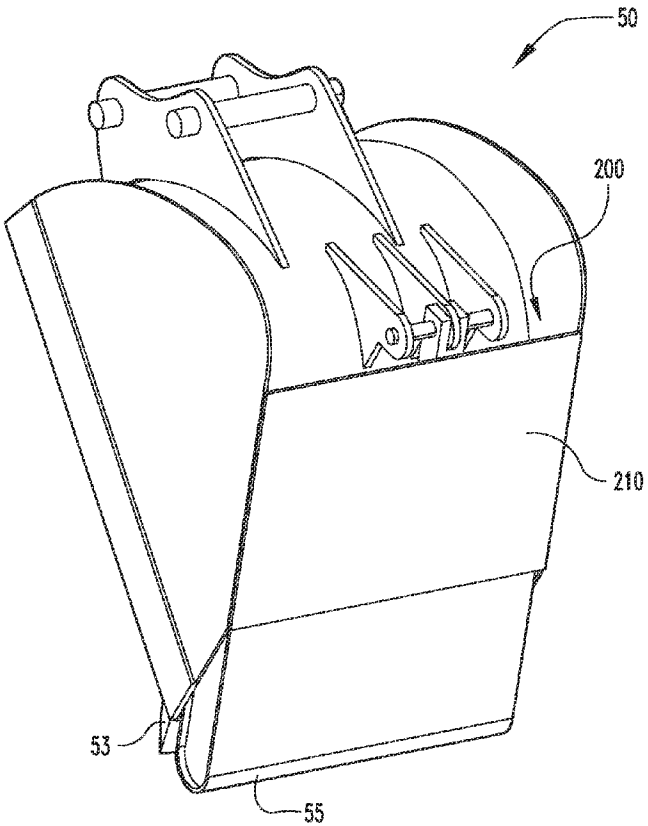
FIG. 12A is a rear perspective view of the bucket of FIG. 10.

In operation 100, as schematically illustrated in FIG. 7, microprocessor 25 is first programmed with the location and depth parameters of the grade or excavation to be dug 105. The reference signal 30 is received 110 by the depth sensor 20 and/or microprocessor 25 when the digging machine is in operation, and the depth of the bucket 50 is calculated in substantially real-time. The location of the bucket 50 is also typically calculated from information supplied by the location sensor 15 and received 115 by the microprocessor 25. In some embodiments, the position sensor 15 may also be used to calculate the orientation of the bucket 50, such as its degree of pivot relative to a predetermined base orientation, such as teeth down and parallel to the horizontal. The depth, location and orientation information are used to calculate the position of the bucket 50 and this is compared 120 by the microprocessor 25 to the programmed grade information. If the bucket 50 begins exceed 125 programmed grade parameters, such as moving deeper than the programmed grade, an actuation signal 130, typically a voltage, is generated by the microprocessor 25 and sent to the hydraulic pump 40, energizing the pump 40 and actuating the cylinder 45 to extend 145 and pivot the interrupt bar 55 into position to engage the ground ahead of the bucket 50. This operation is shown sequentially in FIGS. 9A-9C, wherein the interrupt bar 55 connected to a skid loader bucket 50 is moved from a standby position (FIG. 9A) into an engaged position (FIG. 9C), preventing the bucket 50 from digging into the ground and, typically, slightly lifting the front end of the loader. If the bucket position does not exceed 135 the programmed grade parameters, a null signal 140 is sent to the pump 40. Engagement of the ground by the interrupt bar 55 prevents the shovel or bucket 50 from penetrating deeper into the ground. The microprocessor 25 may then query the sensors 15, 20 for bucket location information, and the cycle starts over. It should be noted that although the process of digging to grade is typically one of vertically removing dirt, the programmed grade may likewise be a substantially horizontal parameter, such as the walls of a dug basement. The microprocessor 25 may likewise combine vertical, horizontal, and/or bucket orientation parameters to govern the excavation of curved and/or complex shape surfaces.

The interrupt bar 55 is typically an elongated member made of a structural material, such as steel. The interrupt bar 55 is more typically rounded or generally cylindrical. The interrupt bar 55 is generally U-shaped, having an elongated and generally rounded middle portion 70 and parallel connection members 75 extending from either end of the middle portion at generally right angles from the axis of the middle portion 70. The middle portion 70 and connection members 75 may define a unitary piece (see FIGS. 10-12B), or may be connected together as separate pieces.

Figure 2:
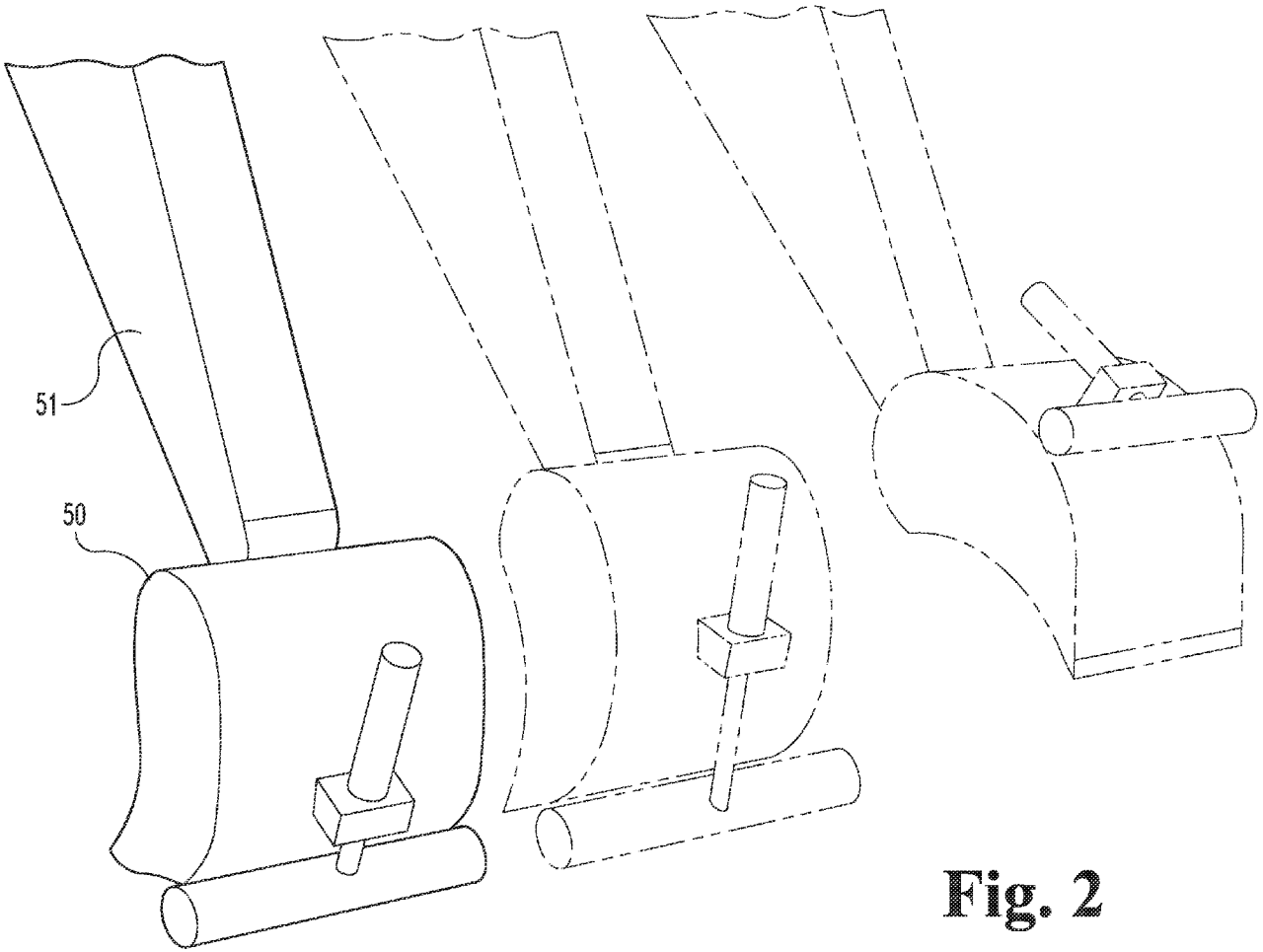
FIG. 2 is a perspective view of a second embodiment of the present novel technology, a system for automatically maintaining a back hoe bucket on grade during a digging operation.
Figure 3:
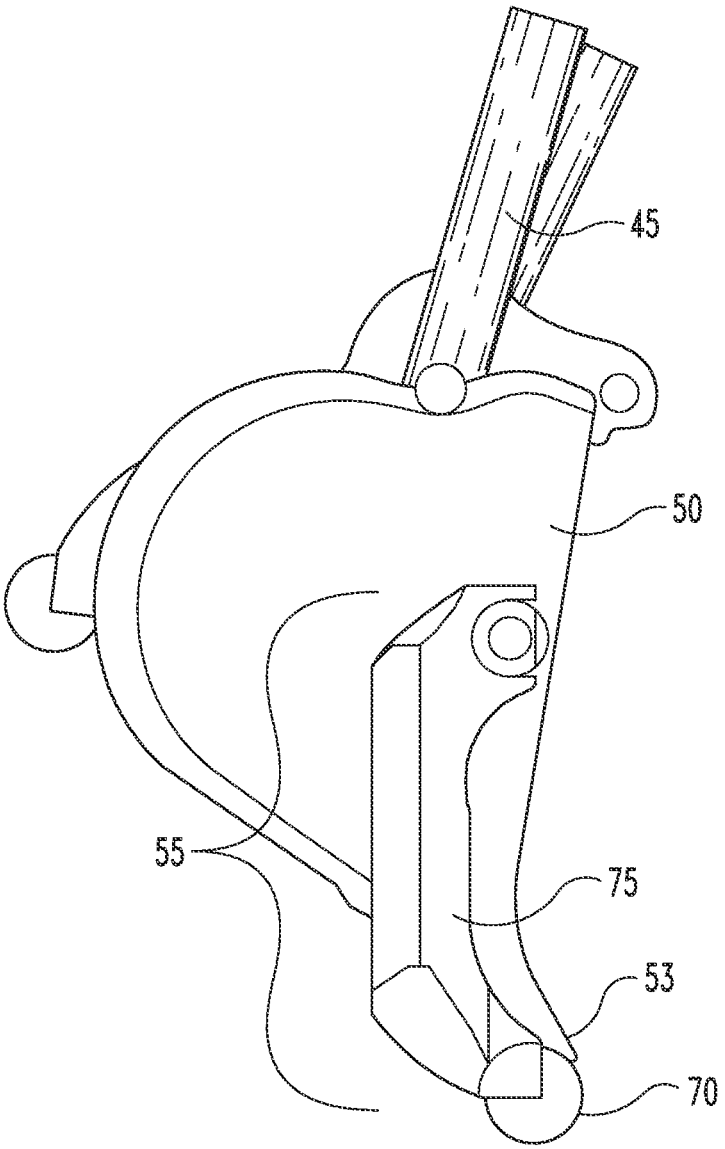
FIG. 3 is a side elevation view of a first embodiment back hoe bucket of the resent novel technology.
Figure 4B:
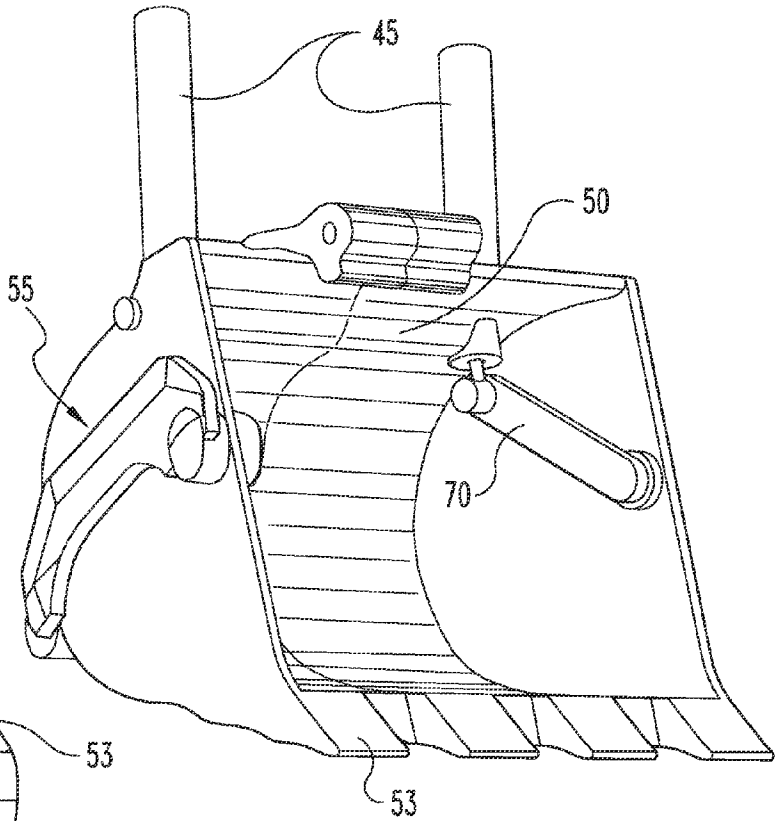
FIG. 4B is a perspective view of the bucket of FIG. 2 having the contact member disengaged.
Figure 4A:
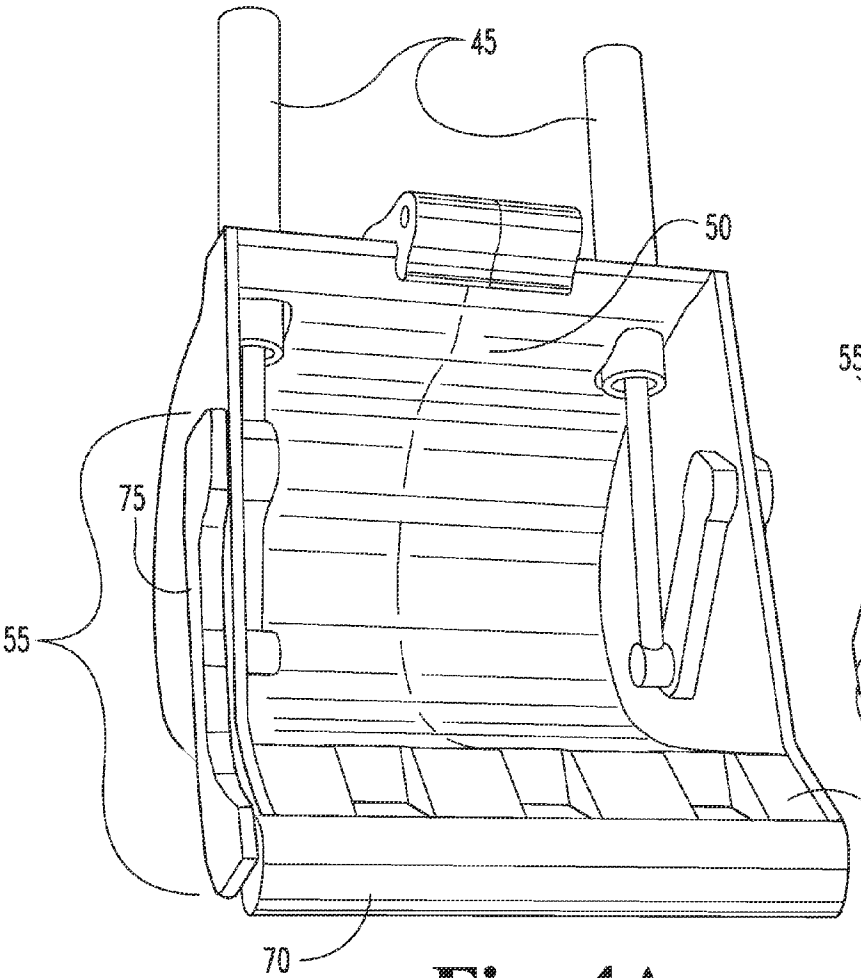
FIG. 4A is a perspective view of the bucket of FIG. 2 having the contact member engaged.
Figure 5B:
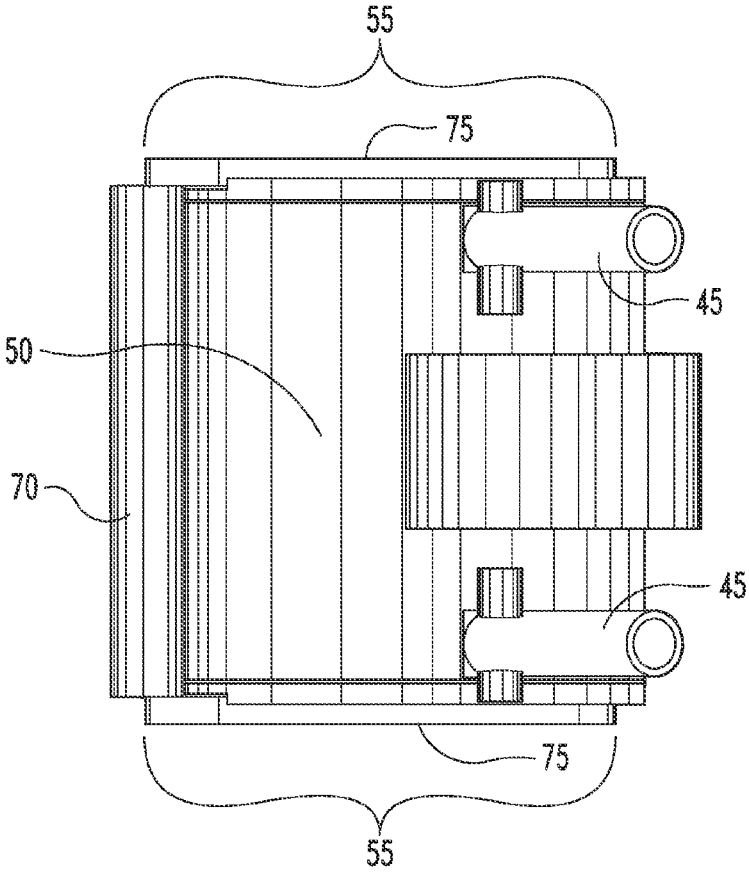
FIG. 5B is a top plan view of the bucket of FIG. 2 having the contact member disengaged.
Figure 5A:
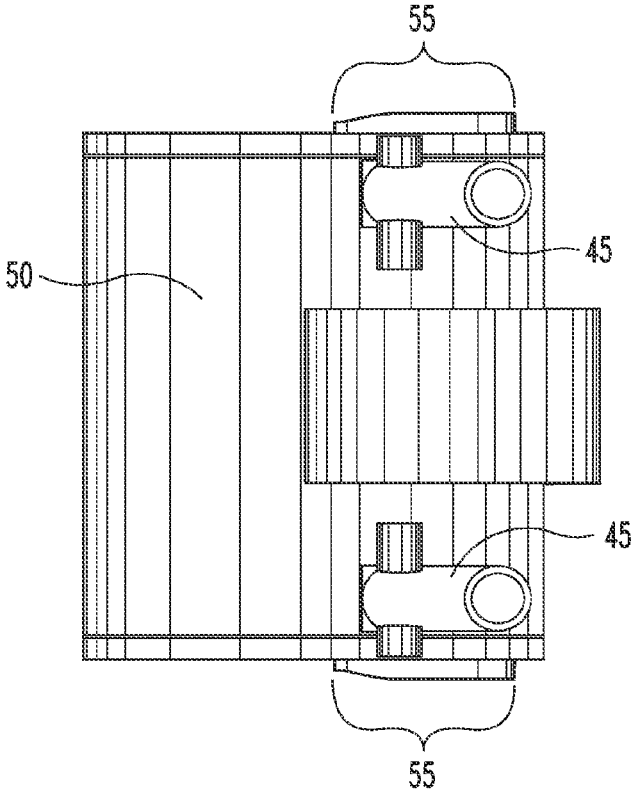
FIG. 5A is a top plan view of the bucket of FIG. 2 having the contact member engaged.
Figure 6B:
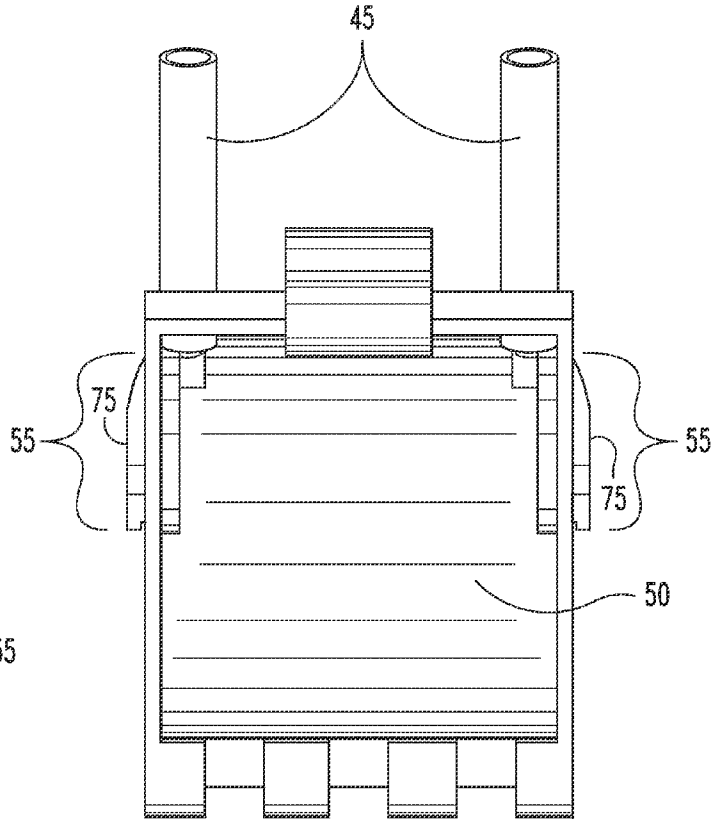
FIG. 6B is a front elevation view of the bucket of FIG. 2 having the contact member disengaged.
Figure 6A:
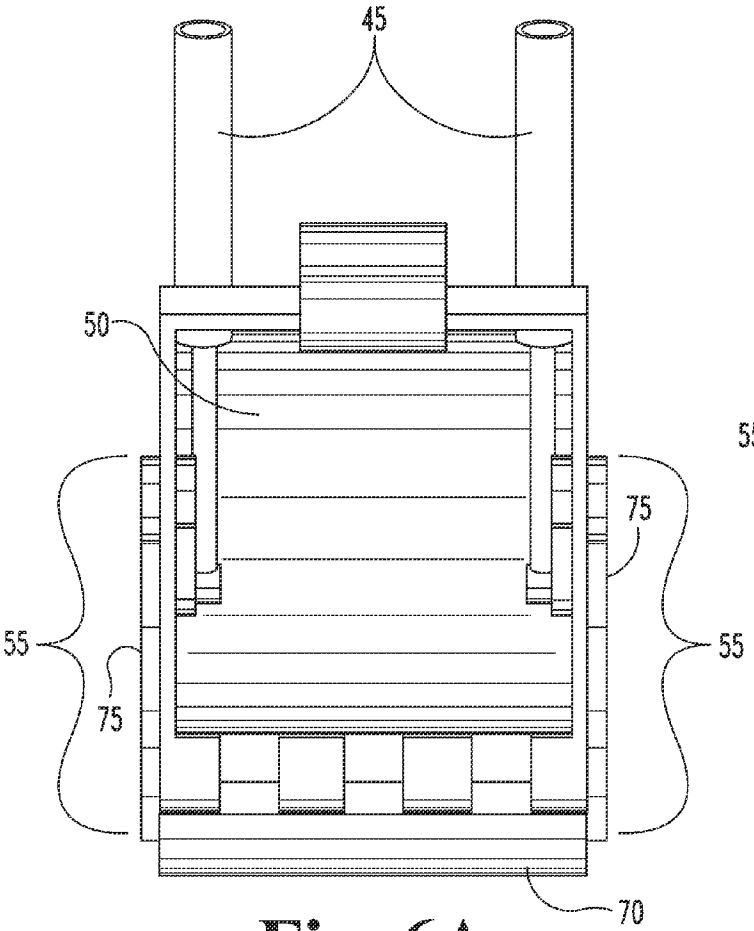
FIG. 6A is a front elevation view of the bucket of FIG. 2 having the contact member engaged.

FIG. 2 illustrates one specific configuration of the system 10 wherein a single hydraulic cylinder 45 is used to pivot the interrupt bar 55, while FIGS. 3-9C illustrate a configuration wherein a pair of cylinders 45 are used. The cylinders 45 are illustrated as positioned in the interior of the bucket 50, but may likewise be positioned adjacent the exterior of the bucket 50.

FIGS. 10-12B illustrate a variation of the bucket 50 illustrated in FIG. 2 and discussed above, wherein the interrupt bar 55 and piston-cylinder actuator 45 are enclosed in a recess 200 formed in the bucket 50. In this embodiment, the recess 200 is defined by inner bucket wall 205 and outer bucket wall 201 which create the double-walled bottom portion or recess 200. The actuator 45 is positioned in the recess 200 and is fixedly mounted to the bucket 50 at one end and to the interrupt bar 55 at the other. Energization of the actuator 45 advances the interrupt bar 55 out of the recess 200 to a position adjacent the cutting edge 53, where it is interposed between the bucket 50 and the ground. Bottom wall 210 acts to protect the actuator 45 from clogging by dirt and debris, as well as from impact damage and the like.

In other embodiments, the grade predetermination function of the microprocessor may be replaced by a mechanical grade indicator, such as a string, line or surface, and the microprocessor voltage or signal generation function may be replaced mechanically, such as by a contact switch or control armature or member.

Figure 13:
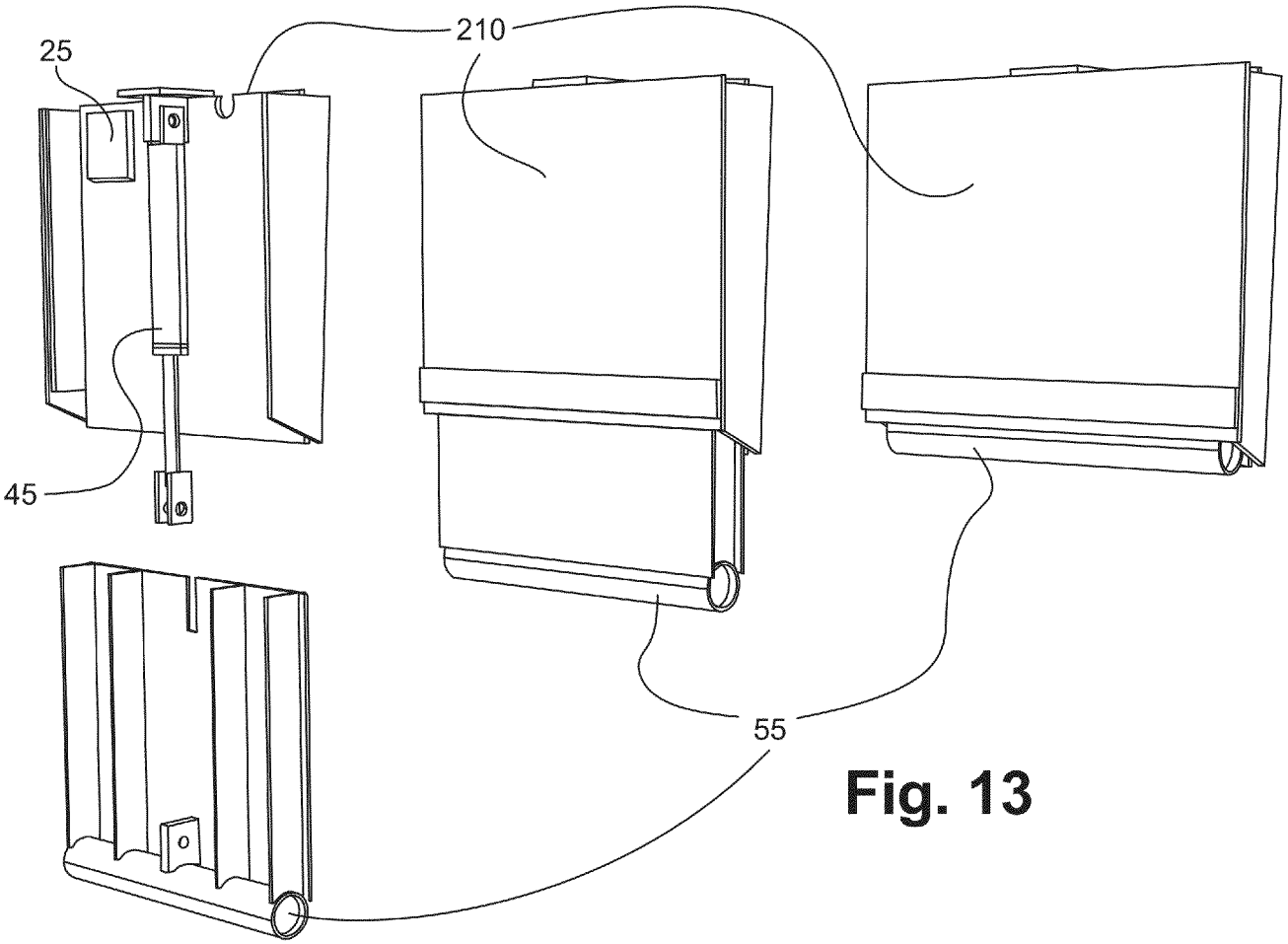
FIG. 13 is an exploded perspective view of a third embodiment of the present novel technology, a kit for converting a standard hoe bucket into a bucket according to the embodiment of claim 1 or 2.

In one embodiment, as shown in FIG. 13, a kit 250 is provided for retrofitting existing buckets. The kit 250 includes an interrupt bar 55 operationally connected to a piston actuator 45 and connectable to and/or slidingly disposed in a housing 210. The housing 210 is structurally connectable to a bucket, such as by bolting, welding, or the like, to define a bottom wall 210. One or more s sensors 15, 20 are typically connected to, and more typically disposed within, the housing 210 and are likewise operationally connectable to a controller 25 (as shown in previous FIGs.). The piston actuator 45 is connectable to a hydraulic pressure source.

Figures 14A, 14B:
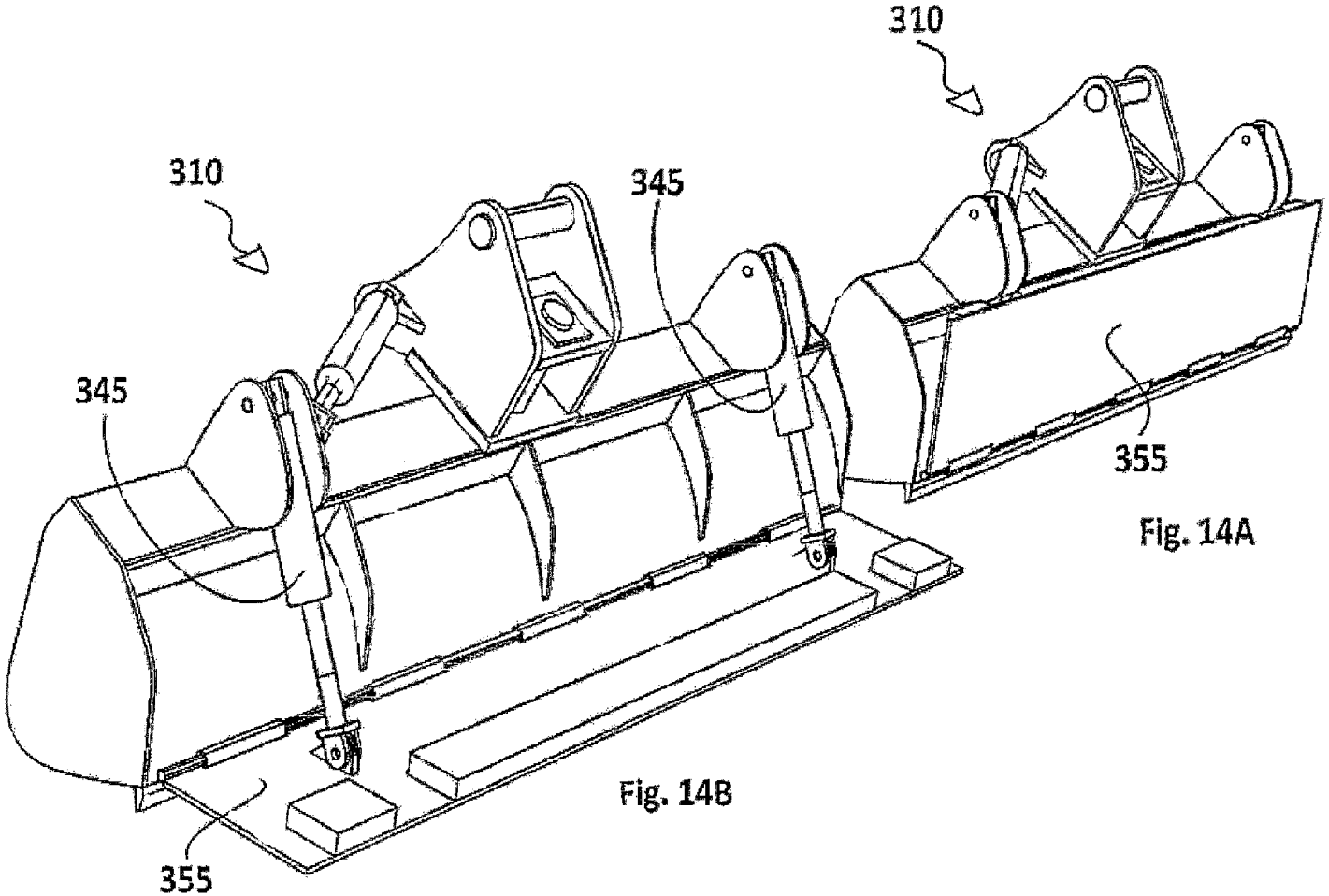
FIG. 14A is a perspective view of a fourth embodiment of the present novel technology, and elongated bucket having an interrupt plate operationally connected thereto.
FIG. 14B is a perspective view of the embodiment of FIG. 14A with the interrupt plate pivoted.

In another embodiment, as shown in FIGS. 14A and 14B, a system 310 is shown wherein hydraulic cylinders 345 are connected to a bucket 350 and may be energized to pivot an interrupt plate 355 pivotably connected thereto, urging the plate 355 into engagement with the ground to maintain controlled contact of the bucket 350 with the ground and ensure a maximum depth of cut. The cylinders 345 are illustrated as positioned in the exterior top portion of the bucket 350. The bucket 350 is illustrated as a wide bucket having an aspect ratio similar to that of a loader or dozer bucket or blade, but may have any convenient shape.

Figure 15:
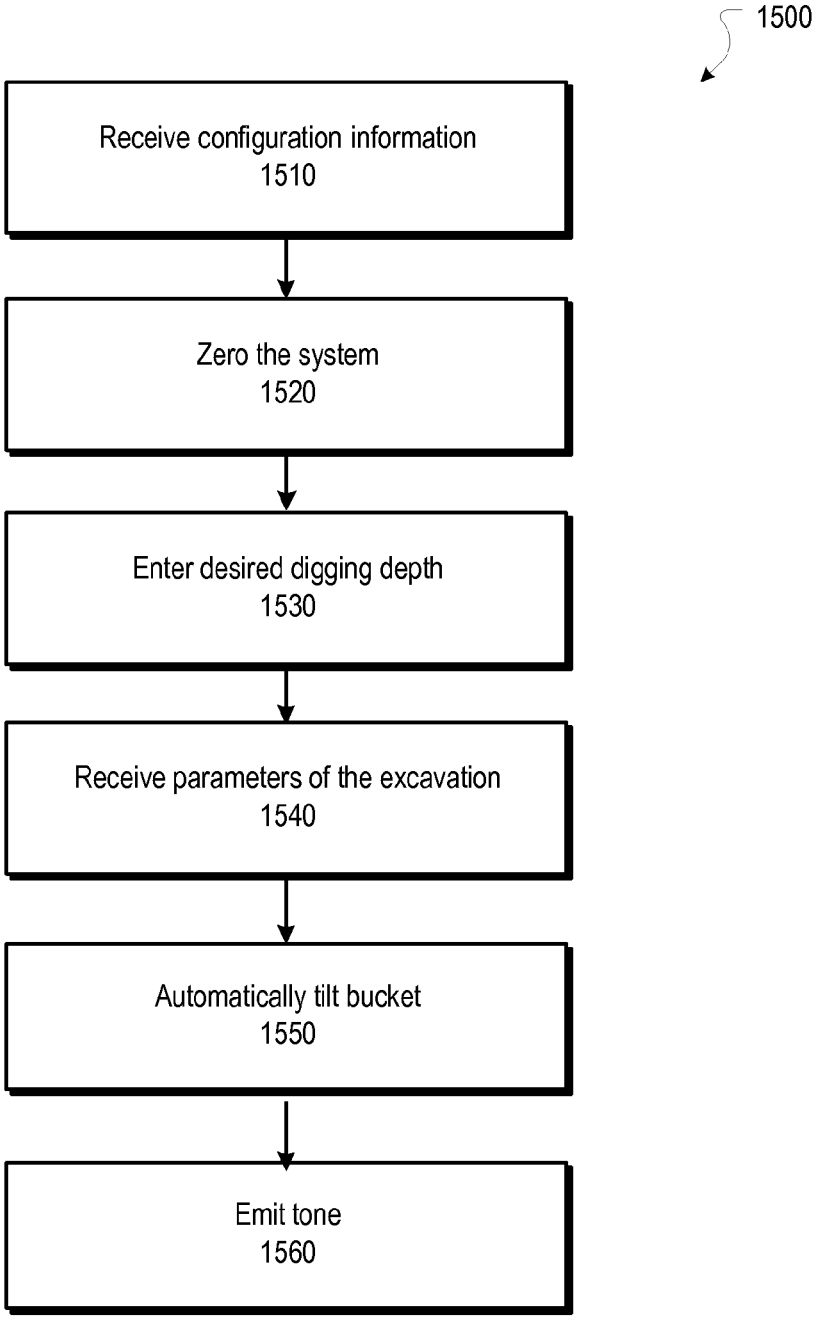
FIG. 15 is a block diagram illustrating an example method of maintaining a back hoe bucket on grade during a digging operation.

FIG. 15 is a block diagram 1500 illustrating am example method of maintaining a back hoe bucket on grade during a digging operation. In some implementations, the system 10 receives initial configuration information (1510) concerning the length of the segments of the boom assembly (the entire actuated arm assembly to which the bucket is distally attached), dimensions of the bucket 50, dimensions of the hydraulic or pneumatic cylinders 45, chassis assembly, and the like. In some implementations, the system 10 is also configured by operating the system to move to various set points. The set points include the boom fully extend, the boom at a 90 degree angle, and the like. In some implementations, the system is preconfigured with the configuration information for industry common back hoes and back hoe assemblies. In these implementations, a user can select his back hoe from the list of preconfigured back hoes rather enter in the configuration information. The configuration information is stored in a non-volatile memory.

If the system 10 has already been configured, the user begins by zeroing the system 10 (1520). Zeroing the system 10 is performed by maneuvering the bucket to just touch the ground. In some implementations, the system's sensors will automatically zero the system 10 (1520). For example, a laser range finder may automatically determine the zero point for the system 10. The user then enters the desired digging depth (1530). Alternatively, if a trench or hole or the like is already partially existing, the user can simply maneuver the bucket to rest upon the bottom of the trench or hole or the like to enter the desired digging depth (1530). In some implementations, the system 10 will emit a sound, in addition to automatically leveling the bucket, when the bucket has reached the desired digging depth or grade.

The system 10 then receives the remainder of the parameters of the excavation from the user (1540). For example, some excavations may require the sides of the excavation have a slope different than perpendicular to the bottom of the hole or trench. In such a case, the user can enter a desired slope. Alternatively, the user can have the system 10 register and duplicate an existing slope by maneuver the bucket to press flat against an already existing sloped partial excavation. For example, a water retention pond may already be partially dug. A user can have the system 10 register and duplicate the existing slope of the partially dug water retention pond by maneuvering the bucket such that the back of the bucket is pressed against the existing side of the retention pond. Note that a user can also simply enter in the entire profile of an excavation (length, width, slope, and depth of the excavation) rather than enter the data in a piecemeal manner. The use of a profile also enables the user to register a stop point in the excavation and begin from that point at a later time. For example, a user could register a stop point, break for lunch, and then begin from that stop point after lunch. Additionally while presented singularly, multiple values can be entered into the system 10 for more complex excavations. For example, a terraced retention pond with multiple plateaus and multiple angled sloped sides could also be entered and excavated by the system 10.

During the excavation, the system will automatically tilt the bucket (1550) accordingly as the excavation nears the desired grade or depth. For example, the system 10 will tilt the bucket upwards as the dug depth nears the desired grade. In this way, the system 10 prevents digging the user from digging too deep. In some implementations, the angle of the bucket's teeth with respect to the horizon when the bucket is near grade is modeled by the system 10 as the angle=(gain*2.5)*(inches above grade) or angle=−(gain*2.5)*(inches below grade), where the maximum value of inches is 24 and gain is a user configured parameter. The angle is continuously adjusted as the bucket moves.

Upon reaching the desired grade, the system 10 will emit a tone (1560) that instructs the operator that the desired grade has been achieved. The system 10 will also emit a second tone in the event that a grade greater than the desired grade has been reached. The second tone functions to instruct the operator to stop digging and to possibly put back some of the removed dirt back into the area that was being dug.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

I claim:

1. A kit for modifying a digging bucket for precision control, comprising:

a housing for connection to the bottom of a digging bucket;

an elongated member disposed in the housing and operationally connectable to a digging bucket defining a cutting edge;

an actuator operationally connectable to the elongated member;

wherein the actuator may be energized to pivot the elongated member to a position adjacent the cutting edge for engaging ground; and wherein positioning of the elongated member adjacent the cutting edge prevents the cutting edge from digging ground.

2. The kit of claim 1 and further comprising:

an electronic controller operationally connectable to the actuator; and a position sensor operationally connectable to the cutting edge and operationally connectable to the electronic controller.

3. The kit of claim 2 wherein the position sensor includes a GPS transceiver.

4. The kit of claim 2 wherein the actuator includes a hydraulic pump operationally connected to the electronic controller and a hydraulic cylinder operationally connected to the elongated member and to the hydraulic pump.

5. A kit for modifying a digging bucket, comprising:

a housing for connection to the bottom of a digging bucket;

an elongated member positioned in the housing and operationally connectable to a digging bucket;

an actuator operationally connectable to the elongated member;

wherein the actuator may be energized to move the elongated member to a position preventing the digging bucket from engaging ground.

* * * * *